United States Patent [19]

McDaniels, Jr.

[11] Patent Number: 4,883,637

[45] Date of Patent: Nov. 28, 1989

[54] CLOSURE ARRANGEMENT FOR SPENT NUCLEAR FUEL SHIPPING CONTAINERS

[75] Inventor: John D. McDaniels, Jr., Duluth, Ga.

[73] Assignee: Nuclear Assurance Corporation, Norcross, Ga.

[21] Appl. No.: 236,204

[22] Filed: Aug. 25, 1988

[51] Int. Cl.[4] ..... G21F 5/00

[52] U.S. Cl. ..... 376/272; 250/506.1; 220/323; 220/325; 220/256; 292/43; 292/48; 292/256.67

[58] Field of Search ..... 376/272; 250/506.1, 250/507.1; 220/256, 323, 325; 292/43, 48, 155, 256.67

[56] References Cited

U.S. PATENT DOCUMENTS

| | | | |
|---|---|---|---|
| 2,797,948 | 7/1957 | Tangard | 292/155 |
| 4,330,711 | 5/1982 | Ahner et al. | 250/506.1 |
| 4,436,693 | 3/1984 | Zezza et al. | 376/272 |
| 4,445,042 | 4/1984 | Baatz et al. | 376/272 |
| 4,488,048 | 12/1984 | Bienek et al. | 376/272 |
| 4,693,278 | 9/1987 | Wilson et al. | 220/323 |
| 4,754,894 | 7/1988 | Simon et al. | 376/272 |

FOREIGN PATENT DOCUMENTS

| | | | |
|---|---|---|---|
| 0269896 | 6/1988 | European Pat. Off. | 250/506.1 |
| 2732791 | 2/1979 | Fed. Rep. of Germany | 250/506.1 |

*Primary Examiner*—Daniel Wasil
*Attorney, Agent, or Firm*—David P. Kelley

[57] ABSTRACT

A closure arrangement for spent nuclear fuel shipping container has a lid member with a peripheral groove in its outer edge, the lid member being adapted to rests upon a shoulder within a bore at the mouth of the cask. The lid is forced into sealing engagement with the shoulder by a plurality of radially disposed wedges extending from the inner wall of the cask into the peripheral groove. The wedges are moved by bolts extending through the wall of the cask and cam the lid down against the shoulder as they are forced into the groove.

15 Claims, 3 Drawing Sheets

CLOSURE ARRANGEMENT FOR SPENT NUCLEAR FUEL SHIPPING CONTAINERS

BACKGROUND OF THE INVENTION

This invention relates to a closure arrangement for spent nuclear fuel shipping or storage containers.

In the transportation and storage of spent nuclear fuel, it is necessary to use containers for the fuel that prevent the escape of radiation, and that retain their integrity under extreme stresses arising from, for example, their accidentally being dropped, such as may occur in a train derailment. It is imperative that the container, often referred to as a cask, be so constructed that harmful radiation, including radioactive gas, does not escape, and that the heat generated by radioactive decay of the spent fuel is adequately dissipated.

Perhaps the most vulnerable area in a shipping or storage cask is the opening therein through which the spent nuclear fuel is introduced into the cask, or removed therefrom. Ideally, a closure arrangement for the opening should have the same structural integrity as the remainder of the cask under conditions of extreme stress, and should not, under any conditions, permit escape of radioactive gasses from the cask interior.

To achieve these ends numerous types of closure structures for nuclear fuel casks have been designed and used, examples of which are shown in U.S. patents 4,274,007, 4,445,042, and 4,528,454 all of Baatz et al, 4,302,680 and 4,330,711 of Abner et al, 4,488,048 of Bienek et al, and 4,636,645 of Kessinger.

The Baatz et al patents all show dual closure arrangements wherein the inner closure member has a frustoconical shape and bears against a plurality of sealing rings. Both the inner and outer closure are held in place by a plurality of bolts extending through the closures from the top thereof into the body of the cask. Such an arrangement has several drawbacks, among which are the necessity of orienting the closures so that the bolt holes in the closures and the threaded bolt holes in the body are aligned; the necessity of screwing the bolts in from the top, thereby putting the operator in the direct line of any radioactive leakage; the time consumed in aligning the bolts and screwing them in; and the galling of the bolts due to the high degree of friction involved.

Abner et al patent 4,302,680 shows a closure system having a stationary plug member and a bayonet locking movable member which, when locked, applies force against the plug member to hold it in place. Patent 4,330,711 of Abner et al shows a similar arrangement, with a slightly different configuration of the bayonet locking hold down member. Both of the Abner et al patents rely, therefore, on the bayonet locking principle, which, while affording good locking under normal conditions is subject to slippage or unlocking under high stress such as may arise in an accident.

Bienek et al show an arrangement for mounting an inner container or cask within an outer container whereby the inner container and outer containers are held in fixed relationship by frictional engagement of their walls with intermediate spacing members. Of interest in their arrrangement is the locking arrangement shown in FIGS. 15 and 16 of the patent wherein a plurality of horizontally movable spring loaded lock bolts are pushed by the springs into corresponding openings in the spacing element. Such an arrangement is directed to containing the cask within the outer container and is not a sealing arrangement. In order to achieve locking, the bolts must be pulled back against the springs, necessitating access from above, and the springs themselves do not positively position the bolts. Furthermore, the bolt and hole arrangement requires precise orientation of the lid containing the bolts with the holes in the spacer.

The Kessinger patent discloses a closure arrangement which, like the foregoing prior art arrangements, bolts from the top, thereby requiring the operator to work above the cask, in the potentially most dangerous area.

In all of the foregoing prior art arrangements, access to the cask necessitates placing the operator above the cask in the area of most likely leakage. In addition, where high pressures have built up inside of the cask, loosening the closure could cause it to be blown off, with possible serious injury to the operator, and escaping radioactive gasses could be blown directly into his face. In addition, where a plurality of bolts are used to seal the closure and hold it in place, they must be removed in order to remove the closure, thereby creating the risk that one or more may be lost.

In addition, as pointed out before, with most of the prior art devices a precise orientation of the closure is necessary before the closure can be fastened down.

SUMMARY OF THE INVENTION

The present invention through its unique closure arrangement achieves the desiderata of allowing the operator to fasten and seal the closure from the side of the cask, thereby removing him from the potentially dangerous area above the cask. In addition, precise orientation of the closure with respect to the cask is not necessary, thereby reducing the length of time that the operator must remain in the vicinity of the cask. The closure fastening arrangement of the present invention does not require that the fastening members be completely removed, eliminating the risk of lost components of the system and the additional time to reassemble the parts prior to tightening.

In one preferred embodiment of the invention, the closure member for the cask comprises a circular block or lid having a peripheral groove with a slightly sloping wall oriented at the bottom of the groove. The sloping wall of the groove is actually the surface of a very shallow frustrated cone. The cask has either a continuous slot or groove or a plurality of discrete slots within which are slidably contained a plurality of locking dogs or wedges. The dogs are actuated to move in or out by threaded bolts which are threaded through holes in the cask. The cask is provided with an inner shoulder on which the circular closure block or lid rests when in position, and the peripheral groove is, in this position, aligned with the dogs. The underside of the closure block or lid has one or more annular sealing members therein which bear against the shoulder in the cask. Alternatively, the periphery of the block or lid may be fitted with one or more grooves containing sealing rings. To reduce the drag created as the lid is removed or replaced, the peripheral surface of the lid and the matching cask surface may be slightly tapered or conical. The underside of each dog has a concave sloping portion at the front thereof which matches the sloping conical portion of the peripheral groove. When the bolts are screwed in, the dogs are introduced into the groove, and the sloping portion of the dog bears against the sloping wall of the groove, producing a wedging or camming action which forces the closure block down tightly against the cask shoulder. Each bolt has a plurality of spring type washer elements through which the lateral movement of the bolt is transferred to its corresponding dog. These springs are of a type which can produce a substantially uniform or constant load on the bolt as it is screwed in, thereby helping insure that the dog is moved well into the groove without jamming.

In another preferred embodiment of the invention, a double closure arrangement comprises a first, inner closure block which rests upon a shoulder in the cask which may be conical in shape to reduce lid insertion and removal force requirements. Annular sealing elements are located at the edges of the block and bear against a wall of the cask. The wall of the cask has an annular groove which coincides with the top of the block when it is in its seated position, and mounted on the top of the block is a bayonet locking arrangement whose locking members ride in the annular groove. Mounted above the bayonet mechanism is a second closure block which is substantially identical to the closure block in the first preferred embodiment and is locked in place in the same manner as the first embodiment. On the underside of the second block are a plurality of projections which extend down almost to the first block. These projections, when the block is in place, serve to prevent the bayonet lock mechanism from unlocking.

The various features of the present invention will be more readily apparent from the following detailed description and accompanying drawings.

DETAILED DESCRIPTION

Figure 1:
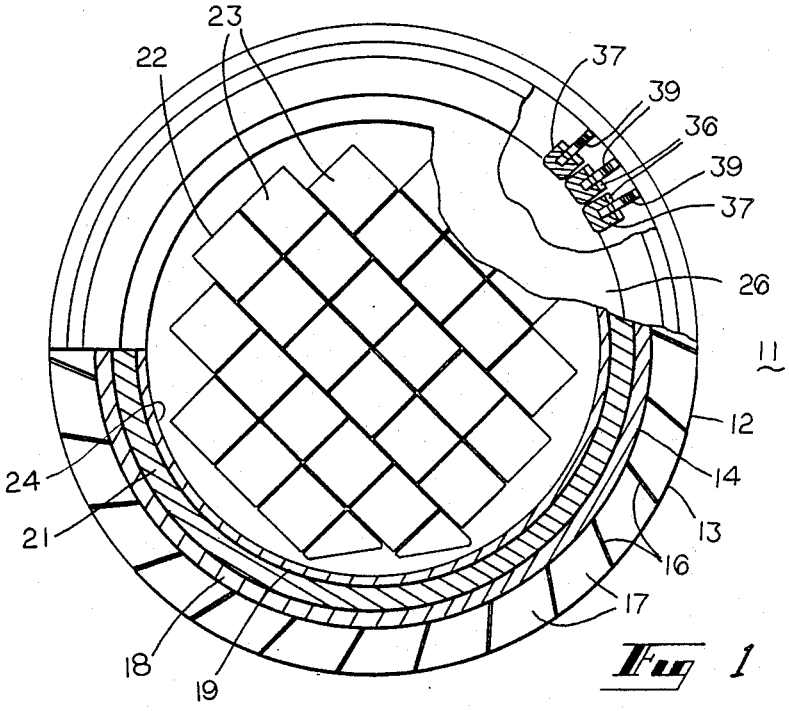
FIG. 1 is a plan, partially cutaway view of the cask and closure arrangement of one embodiment of the invention.
Figure 2:
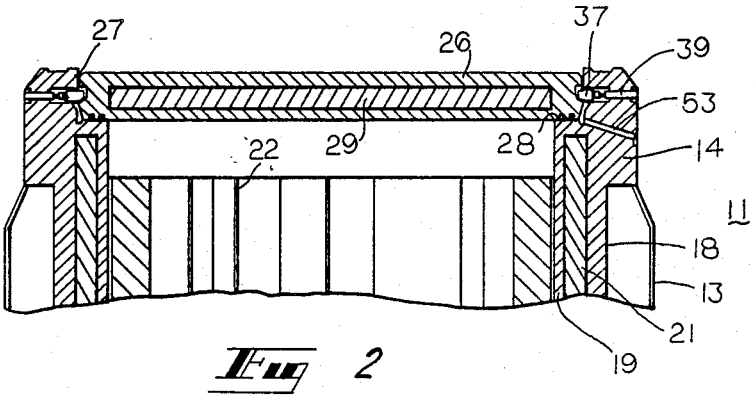
FIG. 2 is a sectional elevation view of the cask and closure of FIG. 1.

In FIGS. 1 and 2 there is shown a cask and closure assembly 11 embodying the principles of the present invention. Assembly 11 comprises a cask 12 having an outer cylindrical shell 13 and an inner shell 14 which are made of, for example, stainless shell. Shell 13 and shell 14 are separated from each other by a plurality of bimetallic cooling or heat transfer fins 16, and the spaces 17 thus created are filled with neutron absorbing material such as, for example, water, or a suitable hydrogen containing material such as BISCO®. Inner shell 14 comprises first and second spaced concentric members 18, 19 which create a space 21 which is filled with a suitable radiation absorbing material such as, for example, depleted uranium or lead. The absorbing material functions to prevent escape of radiation from the cask. Within member 19 of the inner shell 14 is a fuel basket 22, preferably made of an alloy of boron and aluminum, e.g. BORAL®, whereby it functions as a neutron poisoning material. Alternatively, basket 22 may be made of aluminum or stainless steel, or other suitable material. Basket 22 contains a plurality of cells 23, 23 into which spent fuel rod assemblies are fitted. Any empty spaces, including the spaces between basket 22 and the inner wall 24 of member 19 or of shell 14, are preferably filled with a heat transfer medium and a neutron poisoning material, such as BORAL®. For simplicity the remainder of the cask has not been shown, inasmuch as it is of substantially standard configuration except for the closure system.

Figure 3:
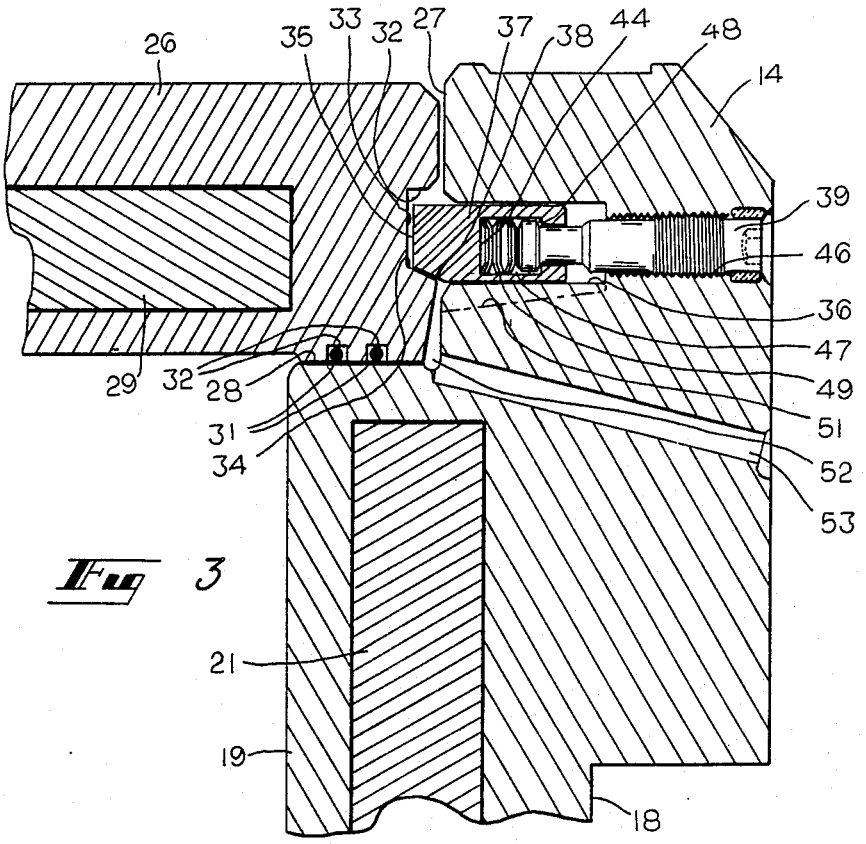
FIG. 3 is a detailed cross-sectional view of the closure locking arrangement of FIG. 1.

The closure arrangement for the cask 12, as best seen in FIGS. 2 and 3, comprises a closure block or lid 26, preferably of the same material as cask 12, which fits snugly into a bore 27 at the top of cask 12 and rests upon a shoulder 28 formed at the bottom of bore 27. Lid 26 is preferably formed with a space 29 therein which is filled with suitable radiation absorbing material such as lead or depleted uranium. The bottom portion of lid 28 has a pair of annular sealing O-rings 31, 31 which are fitted into annular grooves 32, 32 in lid 26 as best seen in FIG. 3. O-rings 31, 31 are preferably of a sealing material capable of withstanding large stresses without losing sealing integrity. Some polymers have appropriate properties to function as O-rings 31, 31 as does Incomel R.

Figure 4:
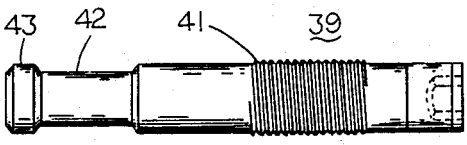
FIG. 4 is a detail of one of the bolts used in the closure locking assembly.
Figure 6:
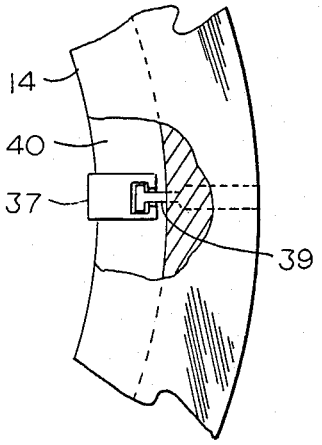
FIG. 6 is a partial plan view of the mounting of the locking members in a single, continuous channel in the cask.

As best seen in FIG. 3, lid or closure block 26 has a peripheral groove 35 having an upper wall 32, an inner wall 33, and a lower wall 34. As can be seen, lower wall 34 slopes down from inner wall 33 to the edge of lid 34. It can be appreciated that since groove 35 is circular, lower wall 34 is actually the surface of a very shallow frustrated cone. Located in flange member 14 is a plurality of slots 36, 36 each of which is oriented opposite groove 35 when closure lid 26 is resting on shoulder 28. Alternatively instead of slots 36, 36, a single continuous slot groove 40 may be formed in flange member 13, as seen in FIG. 6. Within slots 36, 36, are mounted with a sliding fit, a plurality of locking wedges or dogs 37, 37, with a portion of the lower surface 38 being tapered, as shown, at an angle substantially the same as the angle of slope of lower wall 34. Lower surface 38 is slightly concave to match the conical surface of wall 34. Rotatably connected to each dog 37 is an actuating bolt 39 as shown in FIG. 4, comprising a threaded portion 41, a neck 42 and an enlarged portion 43. Bolt 39 is threaded through a threaded hole 46 in the flange shell 14 which extends between slot 36 and the outside of shell 14, as shown. Portion 43 of bolt 39 fits within a recess 47 at the rear of dog 37 and the bolt is rotatably held in place therein by a ledge 48. Bolt 39 can be actuated or turned by any suitable means. In FIGS. 3 and 3A the end of bolt 39 is shown provided with a hex socket for actuation by a socket wrench. Enlarged portion 43 presses against a plurality of spring washers 49, 49 which bear against the bottom of a spring cavity 44 in dog 37. These washers are preferably of the type known as Belleville washers which can be stacked to produce either a relatively constant load under varying conditions or a sizeable spring rate. The washers may be either nested within one another or arranged to oppose one another or a combination of both.

These spring washers 49, 49, provide a number of features. Without the spring loading it is possible that the cask flange portion 14 might be heated in a fire accident such that the differential expansion of the cask flange relative to the block or lid 26 could result in one or more loose dogs or wedges 37, 37. It is widely accepted that spring loading will impede loosening of a bolt or a nut. These springs serve as a means to help prevent loosening of the locking bolts as a result of vibration or differential expansion.

Unlike a long stud in a conventional closure which stretches when the nut is tightened, the short locking screw 39 has little compression or elongation, thus when the dog or wedge 37 contacts the block or lid 26, the screw will abruptly stop turning where no spring is provided. Thus the operator loses all feel as to the seating of the wedge 37 or whether the screw or bolt 39 has been properly tightened or has entered into an interference position far from proper seating. The spring loading, on the other hand, with these particular uniquely designed spring washers 49, 49 allows a design selection of, for example, one full turn of the bolt 39 after the dog 37 contacts the lid 26 to provide the operator with a repetitious sequence feel that verifies that proper tightening has taken place Each of slots 36, 36 is provided with a drain groove 51, which communicates with the exterior of the cask through drain passages 52 and 53, and which prevents the accumulation of radioactive liquid or moisture within the slot 36. In a like manner, if a single continuous slot 40 is used, several grooves 51 serve as drain channels.

Bolt or screw 39 and dog 37 are assembled by driving bolt 39 into slot (or groove) 36 until the enlarged end portion 43 is well beyond the surface of bore 27. The dog 37 is then fitted to bolt 39 so that end portion 43 rides in recess 47 and bears against washers 49, 49 which are inserted in cavity 44. The bolt 39 is thus backed out, pulling dog 37 into 36.

Figure 5:
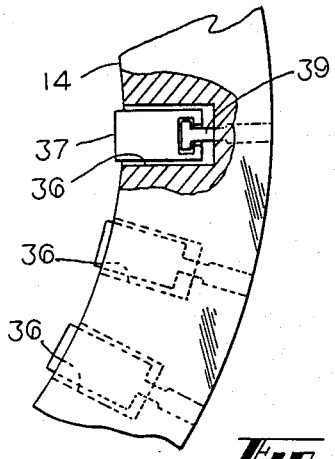
FIG. 5 is a partial plan view of the mounting of the locking members in individual slots in the cask.

FIGS. 5 and 6 depict alternative ways of containing wedges or dogs 37 in place. In FIG. 5, the dogs 37 are each slideably mounted in slots 36, 36, while in FIG. 6, they are carried in a single continuous groove 40 formed in flange member 14.

Figure 7:
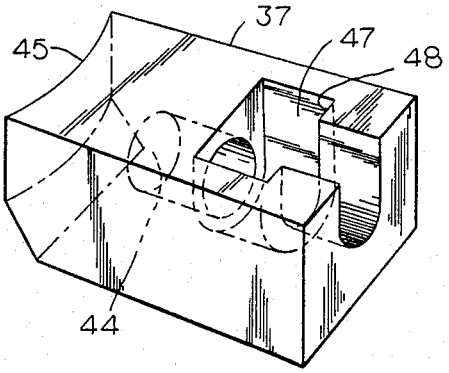
FIG. 7 is a perspective view of the locking wedge of the present invention.

In FIG. 7, the dog or wedge 37 is shown in greater detail. The nose 45 of dog 37 is made concave to match the curvature of wall 33 in the event that dog 37 is driven into groove 35 until surface 45 contacts wall 33. In operation, when bolt 39 is screwed into member 14, it forces wedge or dog 37 forward so that the sloping edge 38 contacts sloping wall 34. Continued forward movement of bolt 39 causes wedge or dog 37 to cam or wedge the closure lid 26 down tightly against shoulder 28. When the lid 26 is in its sealed position, the spring washers function to maintain the locked integrity of the system.

When lid 26 is to be removed, the bolt 39 is backed out a sufficient distance to allow the wedge portion of dog 37 to clear lid 26.

It can be seen that the operator works from the side of the cask, not above it, and hence is removed from the area of potential radiation leakage. It can also be seen that the bolt 39, once attached to the wedge 37, cannot be removed from the assembly, nor can the wedge, thus minimizing risk of loss of any parts. The unique locking arrangement of the invention also permits the lid of the cask to be inserted within the cask, as seen in FIGS. 2 and 3, thereby removing the danger of blows to the side of the lid, which danger exists where the lid is mounted on top of the cask. An additional advantage of the present arrangement is that if during transport, one or more screws were to break, the wedge would not loosen.

Figure 9:
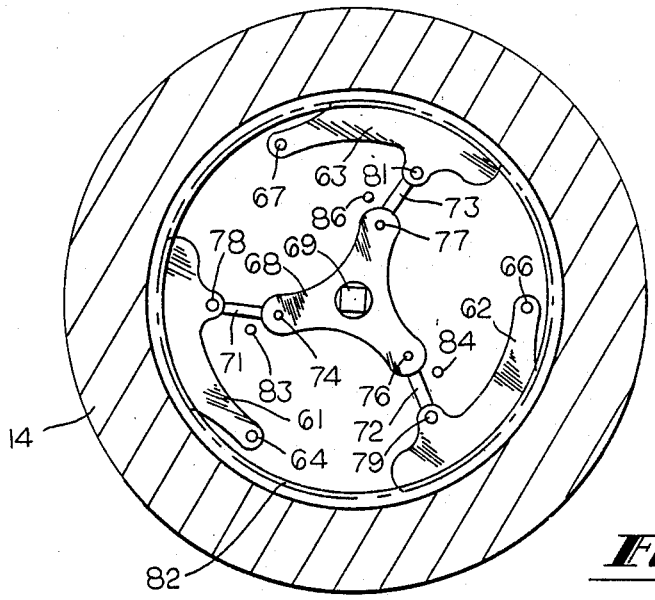
Figure 8:
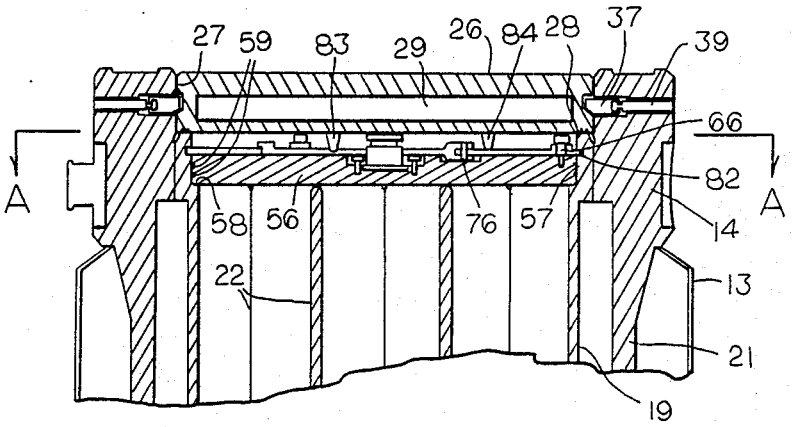
FIG. 8 is a sectional elevation view of another embodiment of the invention having a dual closure arrangement; and, FIG. 9 is a plan cross-section along the line A—A of FIG. 8.

FIGS. 8 and 9 illustrate a double closure arrangement for cask 12, comprising an inner closure lid 56 and an outer closure lid 26. Inasmuch as the locking and sealing arrangement for lid 26 is substantially identical to that shown in FIGS. 1, 2 and 3, the details thereof will not be repeated. In addition, to avoid confusion, parts corresponding to the same parts in FIGS. 1, 2, and 3 have been designated by the same reference numerals.

Inner closure lid 56 is designed to be a substantial sliding fit in a bore 57 in member 14 and rests upon a shoulder 58 at the bottom of bore 57. Bore 57, which forms shoulder 58, has a smaller diameter than bore 27, thereby creating shoulder 28 at the top of bore 57. The combination of bores 27 and 57 can be considered as one stepped bore, with shoulders at the bottom and intermediate the top and bottom of the bore. Mounted in the periphery of lid 56 are a pair of sealing rings 59, 59 which insure a substantially leak proof fit of lid 56 in bore 57. Mounted on top of lid 56 is a locking mechanism which comprises three locking blades 61, 62 and 63, each of which is pivotably mounted to the top of lid 56 by pins 64, 66 and 67 respectively. Rotatably mounted in the center of the top of lid 56 is an actuating spider 68 having a square head 69 thereon for actuation by a wrench, for example. Head 69 may take take any of a number of forms, the square shape shown in FIG. 5, being by way of example only. Actuating arms 71, 72 and 73 are pivotably mounted to spider 68 by pins 74, 76 and 77 respectively and to locking blades 61, 62 and 63 by pins 78, 79, and 81 respectively. Member 14 of cask 12 has an annular groove 82, located a distance from shoulder 58 approximately equal to the thickness of lid 56 into which blades 61, 62 and 63 fit when lid 56 is in position and the locking mechanism is actuated.

In operation, member 69 is rotated so that blades 61, 62 and 63 are retracted toward the center of lid 56, and lid 56 is fitted into bore 57 until it rests upon shoulder 58. Head 69 is then rotated by any suitable means, thereby rotating spider 68, forcing blades 61, 62 and 63 into the groove 82, thereby locking lid 56 in place. Under normal conditions, tee blades will remain in place and the mechanism locked. However, under extreme stress or sudden shock, spider 68 might be turned slightly, hence loosening the blades 61, 62 and 63. To prevent such an occurrence, lid 26 has projections 83, 84 and 86 on the underside thereof which, when lid 26 is in place, extend down almost to the top surface of lid 56. When lid 26 is mounted, it is turned until the projections 83, 84 and 86 bear against the arms 71, 72 and 73 respectively and lid 26 is then locked in place. The projections 83, 84 and 86 then prevent their associated arms from moving in the unlock direction, thereby insuring that sudden stresses or impacts will not loosen the locking mechanism for inner lid 56. Other lock arrangements could be used, such as, for example, a square shaped recess on the underside of lid 26 for receiving square head 69 to prevent its being turned when lid 26 is locked in place.

In addition, lid 26 may be used as an impact device to insure locking of blades 61, 62 and 63 by rotating the lid 26 until projections 83, 84, and 86 strike arms 71, 72, and 73, respectively to help force stubborn blades into groove 82. Conversely, the lid 26 may be rotated in the opposite direction to loosen sticking blades.

To simplify removal of closure lid 56, the unlocking device (not shown) that engages member 69 can also be used to lift lid 56. This is possible because, as can be seen in FIG. 5, member 69 has an undercut groove into which the unlocking device can be fitted, and an upward twisting motion both unlocks and lifts lid 56.

It is readily apparent from the forgoing that the invention comprises a closure arrangement for a spent nuclear fuel cask that minimizes the operator's exposure to radiation, that can be locked into place relatively quickly, and that materially reduces the risk of lost parts. While the foregoing illustrative embodiments of the invention represent preferred forms thereof, various modifications and changes may occur to persons skilled in the art without departure from the spirit and scope of the invention.

I claim:

1. A closure system for closing and sealing a cask member having an open end, said closure system comprising a bore in the open end of the cask forming a shoulder within the open end of the cask, a closure lid for said cask, said lid having a continuous peripheral groove and being adapted to rest upon said shoulder, and a locking means for forcing said lid against said shoulder, said locking means comprising one or more radially extending slots in said cask opening into the periphery of said bore, said slots being located substantially opposite said peripheral groove when said lid rests upon said shoulder, a plurality of wedge means within said slots adapted to enter said peripheral groove for forcing said lid into sealing contact with said shoulder, and means for forcing said wedge means into said peripheral groove.

2. A closure system as claimed in claim 1 wherein there are a plurality of said radially extending slots around the inner periphery of said bore.

3. A closure system as claimed in claim 1 wherein there is a single continuous radially extending slot around the inner periphery of said bore.

4. A closure system as claimed in claim 1, wherein one or more annular sealing rings are located on that portion of said lid that rests upon said shoulder.

5. A closure system as claimed in claim 1 wherein said peripheral groove has a sloping lower wall and said wedge means has a sloping lower edge adapted to bear against said lower wall when said wedge means is forced into said groove.

6. A closure system as claimed in claim 1 wherein said means for forcing said wedge means into said groove comprises a plurality of threaded bores, each of said, threaded bores extending between one of said one or more slots and the outer side wall of said cask opposite said opening, and a threaded member within each of said threaded bores, said threaded member being rotatably secured to said wedge within said slot.

7. A closure system as claimed in 6 wherein said threaded member has an enlarged end portion at its end adjacent said wedge.

8. A closure system as claimed in claim 7 wherein each of said wedge means has a recess therein in which the enlarged end portion of said threaded member is located.

9. A closure system as claimed in claim 7 and further including at least one spring member between said enlarged end portion of said threaded member and said wedge means.

10. A closure system as claimed in claim 7 and further including a plurality of spring members between said enlarged end portion of said threaded member and said wedge means, said spring members being arranged to produce a substantially constant force on said wedge means as said thread member is screwed into said threaded bore.

11. A closure system for closing and sealing a cask member having an open end, said closure system comprising a stepped bore in the open end of said cask member, said bore having a first diameter forming a first shoulder within the open end of said cask, and a second, larger diameter forming a second shoulder in said bore, the wall of said bore formed by the first diameter having a continuous annular groove therein, and the wall of said bore formed by the second diameter having one or more radially extending slots formed therein, a first closure member adapted to rest upon said first shoulder, a second closure member adapted to rest upon said second shoulder, said second closure member having a continuous peripheral groove, first locking means mounted on one surface of said first closure member having a plurality of blade members having locked and unlocked positions and adapted to fit into said annular groove when in said locked position, second locking means mounted in said one or more radially extending slots having locked and unlocked positions and adapted to engage said peripheral groove of said second closure member when in said locked position, means for forcing said second locking means into engagement with said second closure member, and sealing members mounted in said first and second closure members.

12. A closure system for closing and sealing a cask member as claimed in claim 11, wherein said blade members are pivotably mounted on said surface of said first closure member, and further including an actuating member substantially centrally and rotatably mounted on said surface, a plurality of actuating arms pivotably connected to said actuating member, each of said arms being pivotably connected to one of said blade member.

13. A closure system for closing and sealing a cask member as claimed in claim 11 wherein a peripheral groove is located substantially opposite said radially extending slots when said second closure member rests upon said second shoulder, and said second locking means comprises a plurality of wedge members within said slots adapted to enter said peripheral groove when in said locked position.

14. A closure system for closing and sealing a cask member as claimed in claim 13 wherein said means for forcing comprises a plurality of bolts each of said bolts being in rotatable engagement with one of said wedge members and being threaded through a threaded hole in said cask.

15. A closure system for closing and sealing a cask member as claimed in claim 12 and including means for preventing said blade members from moving from said locked to said unlocked position when said first and second locking means are in said locked positions, said means for preventing comprising a plurality of projections on the surface of said second closure member adjacent to said surface of said first closure member and extending toward said first closure member between said actuating arms.

* * * * *